US008141528B2

(12) United States Patent
Schneider

(10) Patent No.: US 8,141,528 B2
(45) Date of Patent: Mar. 27, 2012

(54) ACTUATING DEVICE FOR TWO PARALLEL ROTATING CAMSHAFTS

(75) Inventor: Falk Schneider, Korntal-Münchingen (DE)

(73) Assignee: Mahle International GmbH (DE)

( * ) Notice: Subject to any disclaimer, the term of this patent is extended or adjusted under 35 U.S.C. 154(b) by 264 days.

(21) Appl. No.: 12/446,044

(22) PCT Filed: Oct. 18, 2007

(86) PCT No.: PCT/EP2007/061157
§ 371 (c)(1),
(2), (4) Date: Apr. 17, 2009

(87) PCT Pub. No.: WO2008/046887
PCT Pub. Date: Apr. 24, 2008

(65) Prior Publication Data

US 2010/0126443 A1 May 27, 2010

(30) Foreign Application Priority Data

Oct. 18, 2006 (DE) ..... 10 2006 049 243

(51) Int. Cl.
*F01L 1/34* (2006.01)

(52) U.S. Cl. ..... 123/90.17; 123/90.31

(58) Field of Classification Search ..... 123/90.31, 123/90.17, 90.15
See application file for complete search history.

(56) References Cited

U.S. PATENT DOCUMENTS

| | | | | |
|---|---|---|---|---|
| 862,448 | A | 8/1907 | Cornilleau | |
| 5,184,581 | A | 2/1993 | Aoyama et al. | |
| 5,417,186 | A | 5/1995 | Elrod et al. | |
| 5,724,929 | A | 3/1998 | Mikame et al. | |
| 5,809,955 | A * | 9/1998 | Murata et al. | 123/90.17 |
| 6,415,753 | B1 * | 7/2002 | Nagaosa et al. | 123/90.18 |
| 6,505,587 | B1 * | 1/2003 | Scheidt | 123/90.17 |

(Continued)

FOREIGN PATENT DOCUMENTS

DE 19526888 1/1997

(Continued)

OTHER PUBLICATIONS

English abstract for DE-19526888.

(Continued)

*Primary Examiner* — Thomas Denion
*Assistant Examiner* — Daniel Bernstein
(74) *Attorney, Agent, or Firm* — Rader, Fishman & Grauer PLLC

(57) ABSTRACT

The invention relates to an actuating device for two parallel rotating camshafts. The aim of the invention is to optimize the installation space required for such a device. For this purpose, both camshafts (3, 4) consist of two shafts that rotate concentrically one inside the other and that can be rotated in relation to each other. On one end of the camshafts (3, 4), one of the two shafts (3', 3"; 4', 4") is driven by the crankshaft (1) via a single, directly acting force-transmitting element (2). A phase adjuster (5) is provided on the other end of the camshafts (3, 4) and allows the simultaneous adjustment of both shafts (3", 4"; 3', 4') in relation to each other by means of a force-transmitting element (6) acting on the phase adjuster (5). Said force-transmitting element connects a region of a camshaft (3, 4) that is firmly connected to an inner or outer shaft (3", 4"; 3', 4') to an inner or outer shaft (3", 4"; 3', 4'), to be adjusted accordingly, of the other camshaft (4, 3) in a force-transmitting manner.

2 Claims, 1 Drawing Sheet

U.S. PATENT DOCUMENTS

| | | | | |
|---|---|---|---|---|
| 7,198,012 | B2 * | 4/2007 | Suga et al. | 123/90.17 |
| 7,210,440 | B2 * | 5/2007 | Lawrence et al. | 123/90.6 |
| 7,287,499 | B2 * | 10/2007 | Lawrence et al. | 123/90.17 |
| 7,610,890 | B2 * | 11/2009 | Lettmann et al. | 123/90.6 |
| 2003/0079702 | A1 | 5/2003 | Philips | |

FOREIGN PATENT DOCUMENTS

| | | |
|---|---|---|
| DE | 19749911 | 5/1998 |
| DE | 69702633 | 4/2001 |
| EP | 1306527 | 10/2001 |
| EP | 1614867 | 11/2006 |
| GB | 2424256 | 9/2006 |
| JP | 60-67705 | 4/1985 |
| WO | WO-2006/000832 | 1/2006 |

OTHER PUBLICATIONS

English abstract for DE-1974991.
English abstract for JP-60-67705.

* cited by examiner

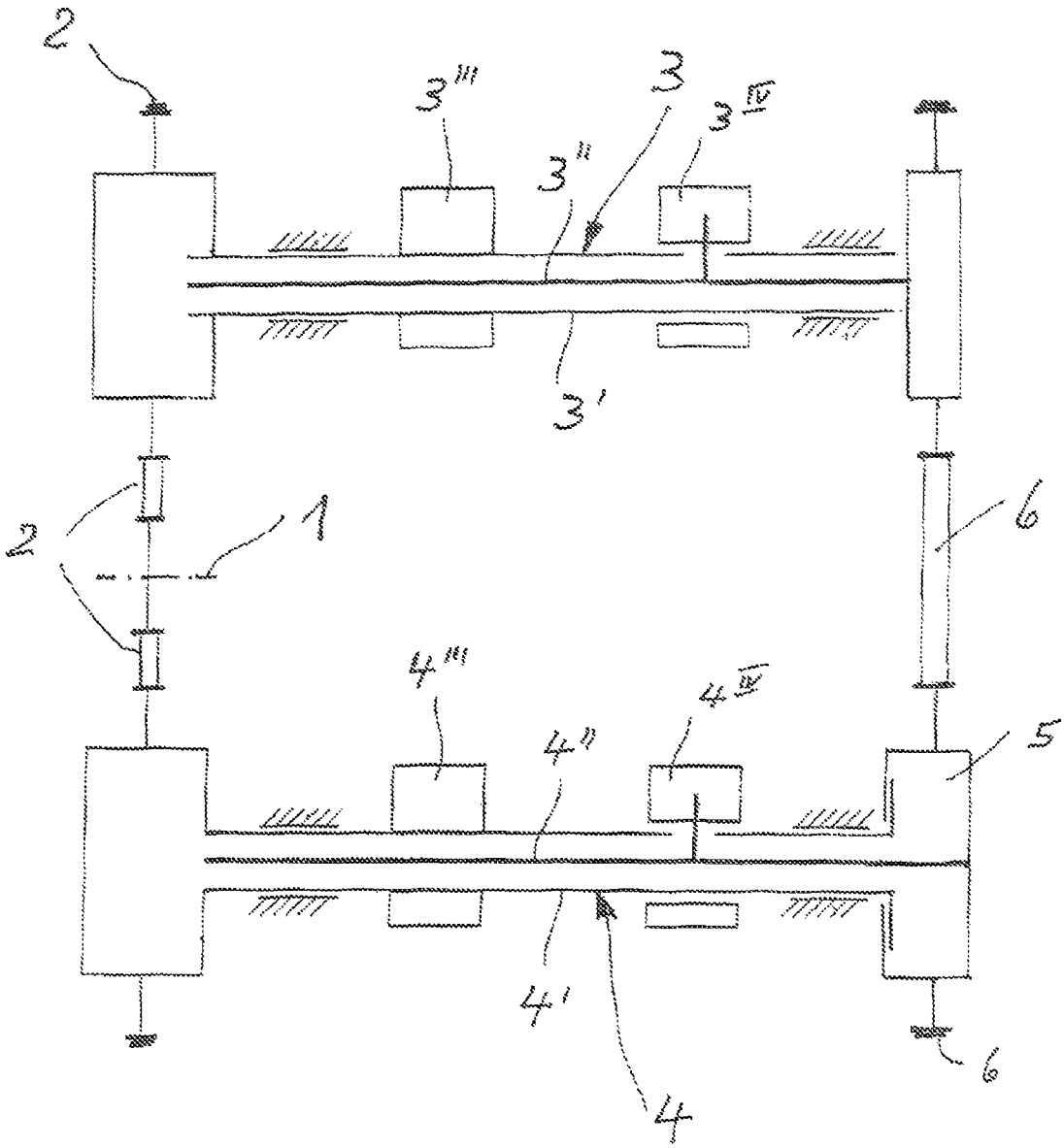
2
3'''
3
3''
3'''
3'
2
1
6
4'''
4''''
4''
5
4'
6
4

ACTUATING DEVICE FOR TWO PARALLEL ROTATING CAMSHAFTS

CROSS-REFERENCES TO RELATED APPLICATION

This application is a National Stage application which claims the benefit of International Application No. PCT/EP2007/061157 filed Oct. 18, 2007, which claims priority based on German Patent Application No. DE 102006049243.9, filed Oct. 18, 2006, both of which are hereby incorporated by reference in their entirety.

The invention relates to an actuating device for two parallel rotating camshafts according to the preamble of the patent claim 1.

Such actuating devices are known from U.S. Pat. No. 5,417,185 A and EP 1 614 867 A1.

In each of these actuating devices, the phase adjuster is located at the same end of the two camshafts at which end they are driven by the crankshaft.

In this region of an internal combustion engine, confined installation conditions can exist by means of which it can be difficult to accommodate the generic phase adjuster therein. This applies in particular to engines which were originally designed for a camshaft actuating device without a phase adjuster and which are intended to be retrofitted with a phase adjuster and individually adjustable camshafts.

The invention is concerned with the problem to provide a solution here which can be realized as simple as possible by means of a design of a generic actuating device according to the characterizing features of the patent claim 1.

The invention is based here on the general idea to arrange the phase adjuster in the generic camshaft device in such a manner that the typical chain drive, which is actuated by the crankshaft as the drive source, can be configured or remain, respectively, in a constructionally simple manner as it is used for camshafts which are not adjustable by means of a phase adjuster.

In the only drawing

FIG. 1 shows a schematic structure of an actuating device according to the invention.

By means of crankshaft 1, which is drawn only by a dot-dashed line, two camshafts arranged parallel to one another, namely a first camshaft 3 and a second camshaft 4, are driven via a chain 2 as a force-transmitting element.

The two camshafts 3, 4 each consist of two shafts which are arranged concentrically one inside the other and which rotate with respect to each other, namely of an outer shaft 3' and an inner shaft 3" for the first camshaft 3, and an outer shaft 4' and an inner shaft 4" for the second camshaft. The outer shaft cams 3'", 4'" and the inner shaft cams $3^{IV}$ and $4^{IV}$ are each firmly connected with an inner shaft and an outer shaft 3", 4"; 3', 4', respectively.

By means of the chain 2 as a force-transmitting element, each of the outer shafts 3', 4' of the camshafts 3, 4, respectively, are driven.

The inner shafts 3", 4" are rotatably mounted inside the outer shafts 3', 4'. To be able to rotate the two inner shafts 3", 4" synchronously with respect to the outer shafts 3', 4', and in particular during engine operation, at one of the camshafts 3, 4, namely the second camshaft 4, at its end which is opposite to the end with which the chain 2 engages, a phase adjuster 5 is provided which is known per se with respect to its function.

This phase adjuster 5 has two regions which can be rotated with respect to each other, one of which is firmly connected with the inner shafts 3" and 4". By actuating this phase adjuster 5, a relative rotation of the inner shaft 4" with respect to the outer shaft 4' of the camshaft 4 takes place. To achieve a synchronous drive of the inner shafts 3", 4", a force-transmitting element 6 configured, for example, as a chain, connects the region of the phase adjuster 5 firmly connected to the inner shaft 4" with the inner shaft 3" of the camshaft 3.

The camshafts 3, 4 are rotatably mounted in bearings 7 within the engine.

All features illustrated in the description and in the following claims can be essential for the invention, individually as well as combined with one another in any form.

The invention claimed is:

1. An actuating device for two parallel rotating camshafts comprising:

a first camshaft assembly, the first camshaft assembly having at least one inner camshaft and at least one outer camshaft; and a second camshaft assembly configured at least generally parallel to the first camshaft assembly, the second camshaft assembly having at least one inner camshaft and at least one outer camshaft, the at least one inner camshafts of the first and second camshaft assemblies having a first end and an opposite second end, the at least one outer camshafts of the first and second camshaft assemblies having a first end and an opposite second end, wherein the inner and outer camshafts of the first and second camshaft assemblies are arranged concentrically, one inside the other, and the inner and outer camshafts rotate with respect to each other, wherein the inner shafts and the outer shafts of the first and second camshaft assemblies include at least one of a first cam connected to the outer shaft and at least one of a second cam connected to the inner shaft, wherein at least one of the inner and outer camshaft first and second ends, is driven by a crankshaft; and at least one phase adjuster is provided at the other opposite first or second end of the inner and outer camshaft of at least one of the first camshaft assembly and the second camshaft assembly, and the at least one phase adjuster providing for selective simultaneous adjustment of both the inner and outer shafts of the first and second at least generally parallel camshaft assemblies by a force-transmitting element which acts on the phase adjuster, wherein the force-transmitting element connects to a firmly connected region of at least one of the inner and outer camshafts of at least one of the first and second camshaft assemblies to be adjusted accordingly, in a force-transmitting manner.

2. The actuating device of claim 1, wherein the at least one phase adjuster is a single adjuster, which is provided at one end of the first and second camshaft assemblies, the single phase adjuster is configured to selectively adjust at least one of the inner camshaft and the outer camshaft of at least one of the first and the second camshaft assemblies simultaneously with the force-transmitting element.

* * * * *

UNITED STATES PATENT AND TRADEMARK OFFICE

CERTIFICATE OF CORRECTION

PATENT NO. : 8,141,528 B2
APPLICATION NO. : 12/446044
DATED : March 27, 2012
INVENTOR(S) : Falk Schneider It is certified that error appears in the above-identified patent and that said Letters Patent is hereby corrected as shown below:

At column 2, claim number 2, line number 55, change "is a single adjuster," to "is a single phase adjuster,"

Signed and Sealed this
Third Day of July, 2012

David J. Kappos

David J. Kappos
*Director of the United States Patent and Trademark Office*